US009693156B2

(12) United States Patent
Johansson et al.

(10) Patent No.: US 9,693,156 B2
(45) Date of Patent: Jun. 27, 2017

(54) MAGNETIC MEANS ASSEMBLY FOR BONE CONDUCTING HEARING AID

(71) Applicant: Oticon Medical A/S, Smørum (DK)

(72) Inventors: Martin Johansson, Smørum (DK); Bengt Bern, Smørum (DK); Anton Hedström, Smørum (DK); Lars Jinton, Mölndal (SE)

(73) Assignee: OTICON MEDICAL A/S, Smørum (DK)

( * ) Notice: Subject to any disclaimer, the term of this patent is extended or adjusted under 35 U.S.C. 154(b) by 2 days.

(21) Appl. No.: 14/670,862

(22) Filed: Mar. 27, 2015

(65) Prior Publication Data

US 2015/0281860 A1 Oct. 1, 2015

(30) Foreign Application Priority Data

Mar. 28, 2014 (EP) ..... 14162259

(51) Int. Cl.
*H04R 25/00* (2006.01)

(52) U.S. Cl.
CPC ..... *H04R 25/606* (2013.01)

(58) Field of Classification Search
CPC ..... H04R 25/606
USPC ..... 381/326; 600/25
See application file for complete search history.

(56) References Cited

U.S. PATENT DOCUMENTS

2009/0245554 A1* 10/2009 Parker ..... H04R 25/70 381/326
2012/0123197 A1* 5/2012 Woodruff ..... A61M 5/14276 600/37
2013/0281764 A1* 10/2013 Bjorn ..... H04R 25/606 600/25
2014/0336447 A1* 11/2014 Bjorn ..... H04R 25/606 600/25
2015/0087891 A1* 3/2015 Bjorn ..... H04R 25/606 600/25
2015/0215696 A1* 7/2015 Bjorn ..... H04R 25/606 600/25

FOREIGN PATENT DOCUMENTS

DE 10 2006 026 288 A1 1/2007
EP 2 592 848 A1 5/2013
WO WO 2004/030572 A2 4/2004
WO WO 2011/163115 A1 12/2011

* cited by examiner

*Primary Examiner* — Duc Nguyen
*Assistant Examiner* — Sean H Nguyen
(74) *Attorney, Agent, or Firm* — Birch, Stewart, Kolasch & Birch, LLP

(57) ABSTRACT

According to an embodiment, a magnetic unit assembly for a bone conducting hearing aid is disclosed. The magnetic unit assembly is implantable and comprises one or more magnetic unit and unit for attaching the one or more magnetic unit to the tissue surrounding the magnetic unit assembly when the magnetic unit assembly is implanted in the body of a hearing aid user. The magnetic unit assembly comprises unit for positioning at least a portion of the one or more magnetic unit in the soft tissue between dermis and the subcutaneous fat or the muscle/fat layer.

22 Claims, 7 Drawing Sheets

Prior Art a)

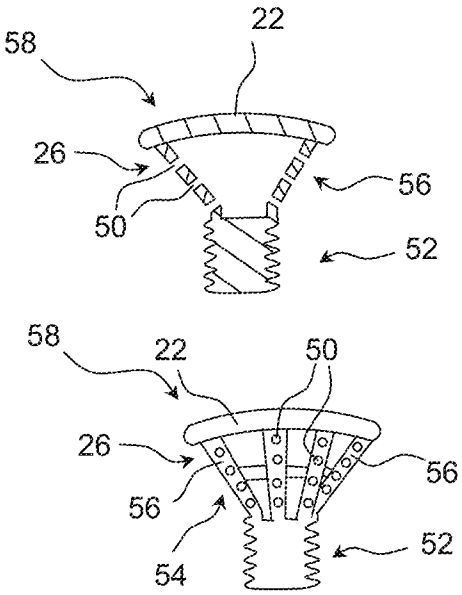
Fig. 6 b)
Fig. 6 c)
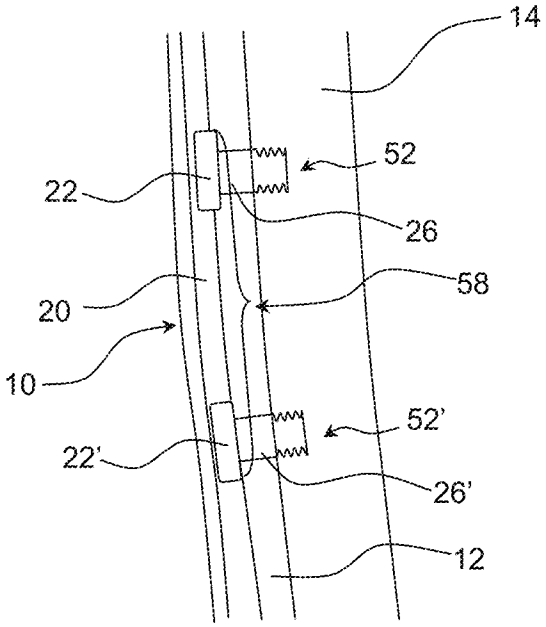
Fig. 6 a)

MAGNETIC MEANS ASSEMBLY FOR BONE CONDUCTING HEARING AID

FIELD

The present disclosure generally relates to a magnetic unit assembly for a bone conducting hearing aid. The present disclosure more particularly relates to a subdermal magnetic unit assembly implant for a bone conducting hearing aid.

PRIOR ART

Implantation of magnetic unit is widely used technique for fixing hearing aids to the skin of a hearing aid user. A bone conduction hearing aid system comprises a vibrator that is adapted to provide a structure-borne acoustic signal transcutaneously or percutaneously transferred to the bony cochlea via bone conduction via the skull bone.

Some bone conduction hearing aid systems have an external hearing aid unit with a sound processor and vibrator. These hearing aid systems are connected to a skin contact pressure plate that is magnetically attached to an implanted unit under the skin. The vibrator transforms an electrical signal into mechanical vibrations and the skin contact pressure plate allows for transmission of the vibrations from the vibrator to the implanted unit when the external hearing aid unit is magnetically fixed to the implanted unit.

It is widely used to apply semi-implantable hearing aid components that comprise an implanted portion as well as external components that are attached to the skin of the user by means of pairs of internal (implanted) and external magnetic unit, respectively. The implanted and external magnetic unit are mutually attracted to one another and thereby fix the external retaining element to the skin of the user.

The magnetic attraction between opposing magnetic unit, on the other hand, cause a pressure load on the "soft tissue" disposed between the implanted and external magnetic unit. The "soft tissue" includes the skin (epidermis and dermis), the subcutaneous fat tissue, and musculature.

A large retention force is required in order to maintain the hearing aid device attached to the skin of the user; however, the load on the "soft tissue" may be crucial. The load on the "soft tissue" may cause short or long term problems such as ischemia or stress concentrations. Too high pressure or unfavourable pressure distribution causing local pressure concentrations may lead to skin problems such as ulcer or necrosis and headache.

In conventional semi implantable hearing aid system the implantable magnetic unit system is typically anchored to the temporal bone, e.g. with bone screws, or placed unanchored on the bone surface below the innermost soft tissue layer (musculature). Some product requires reduction, i.e. skin thinning, of the soft tissue above the implantable magnetic unit to ensure proper attraction of the outer magnetic unit. Skin thinning is associated with a risk of wound complications.

The total force provided to maintain the skin contact pressure plate and the hearing aid unit attached thereto depends on the thickness and geometry of the soft tissue and the elasticity (compression) of the soft tissue between the magnetic unit. These parameters vary between patients and vary in an individual patient over time. It has been reported that the total thickness of the soft tissue lining on the temporal bone range between 2 and 11 mm.

Therefore, in conventional prior art semi implantable hearing aid systems the approximate pressing force needs to be adjusted e.g. by changing the external magnetic unit or change the distance between the magnetic unit in the skin contact pressure plate and the implanted magnetic unit. This complex nature of the prior art hearing aid systems causes an increasing risk for adverse skin reactions due to adjustment errors made by the patient.

For bone conducting hearing aid systems where the sound processor and the vibrator are placed extracorporeal, the problems caused by high pressure on the soft tissue are more significant. As a consequence of the increased weight of the hearing aid a greater retention force is required. The retention force is increased by applying larger magnetic unit or stronger magnetic unit in the skin contact pressure plate. Hereby the total weight of the extracorporeal hearing aid device is increased and the risk for adverse skin reactions is further increased.

Thus, there is a need for a magnetic unit assembly for a bone conducting hearing aid, in which the skin contact pressure can be controlled, for all patients, in a manner that reduces or even eliminates the risk for adverse skin reactions.

WO 2004030572 A2 discloses a retention apparatus for a semi-implantable hearing aid. The retention apparatus includes a first surface and a second surface. One of the first and second surfaces includes a first portion and a second portion having a rounded transition there between for interfacing with a patient's skin. The rounded transition of the interfacing surface of the retention apparatus functions to distribute pressure resulting from the mutual magnetic attraction between an externally located magnetic means and an implanted magnetic means to permit increased magnetic forces there between and maintenance of a desired separation between an external coil and an implanted coil. Since the implanted magnetic means is integrated in the bone tissue of a patient the skin contact pressure depends heavily on skin thickness, and this may vary much from patient to patient, and may also vary over time for the individual patient.

An embodiment of the disclosure provides a magnetic unit assembly for a bone conducting hearing aid, in which the skin contact pressure can be determined and controlled in advance and possibly reduced.

An embodiment of the disclosure to provide a magnetic unit assembly that makes it possible to provide a short distance between external magnetic unit and the internal magnetic unit also in patients with thick skin.

An embodiment of the disclosure to provide a magnetic unit assembly that works properly even if patient gain or lose weight (subcutaneous fat increase or decrease).

SUMMARY

The object of the present disclosure can be achieved by a magnetic unit assembly as defined in claim 1 and by a hearing aid system as defined in claim 13. Preferred embodiments are defined in the dependent claims and explained in the following description and illustrated in the accompanying drawings.

The magnetic unit assembly according to an embodiment of the disclosure is a magnetic unit assembly for a bone conducting hearing aid, which magnetic unit assembly is implantable and comprises one or more magnetic unit and unit for attaching the one or more magnetic unit to the tissue surrounding the magnetic unit assembly when the magnetic unit assembly is implanted in the body of a hearing aid user.

The magnetic unit assembly comprises unit for positioning at least a portion of the one or more magnetic unit in the soft tissue between dermis and the subcutaneous fat or the muscle/fat layer.

Hereby a short distance between external magnetic unit of a bone conducting hearing aid and the internal magnetic unit within the magnetic unit assembly according to an embodiment of the disclosure can be achieved.

Moreover the implanted magnetic unit assembly can be kept in the same distance from the outer skin surface even if patient gain or lose weight.

Due to the short distance between the external magnetic unit of a bone conducting hearing aid and the internal magnetic unit within the magnetic unit assembly, the size of the magnetic unit can be reduced compared to the magnetic unit in the prior art devices.

It is not necessary to provide recesses in the bone for anchoring the magnetic unit assembly.

Only a rather simple surgical procedure is required to provide a patient with a magnetic unit assembly according to an embodiment of the disclosure.

If the subcutaneous tissue grows, the implanted magnetic unit assembly will maintain its distance to the outer skin surface.

The magnetic unit assembly is intended for retaining a bone conducting hearing aid to the skin of the user of the hearing aid.

The magnetic unit assembly is implantable which means that the magnetic unit assembly is suitable for and configured to be implanted in the human body.

The magnetic unit may be of any suitable type and geometry. The magnetic unit may be neodymium magnetic unit made from an alloy of neodymium, iron and boron ($Nd_2Fe_{14}B$) or samarium cobalt magnetic unit (SmCo) by way of example. A magnetic unit in this connection is adapted to cooperate with a further magnetic unit to provide attraction forces between the two. One of the magnetic unit may comprise magnetically soft iron, and may not as such be a magnet, but become magnetically active by the presence of a further magnetic unit, such as a permanent magnet close by. Further, magnetic unit may comprise more exotic magnetically active elements such as ferromagnetic fluids, which comprise powdered ferromagnetic iron or iron alloy suspended in a fluid such as oil. Also mixtures of powders of permanent or soft magnetic materials may be utilised either in free floating form or suspended in a fluid, and enclosed in a bag or similar enclosure. Such elements may be especially well suited for implantation, or for working with implanted magnetically active unit due to their ability to distribute pressure evenly over an area.

The unit for attaching the one or more magnetic unit to the tissue surrounding the magnetic unit assembly when the magnetic unit assembly is implanted in the body of a hearing aid user may be any suitable type of means. The unit for attaching the one or more magnetic unit to the tissue surrounding the magnetic unit assembly may have any suitable size and geometry. However, it may be preferred that a short distance can be kept between the external magnetic unit of the bone conducting hearing aid and the internal magnetic unit within the magnetic unit assembly.

The magnetic unit assembly comprises unit for positioning at least a portion of the one or more magnetic unit in the soft tissue between dermis and the subcutaneous fat.

These unit may be of any type, size and geometry.

It may be an advantage that the magnetic unit assembly comprises unit for positioning at least a portion of the one or more magnetic unit in the soft tissue between dermis and the subcutaneous tissue.

It may be beneficial that the magnetic unit assembly comprises unit for positioning the one or more magnetic unit completely in the soft tissue between dermis and the subcutaneous fat or the muscle/fat layer.

It may be advantageous that the magnetic unit assembly comprises unit for positioning the one or more magnetic unit completely in the soft tissue between dermis and the subcutaneous fat.

Hereby it is achieved that the distance between the external magnetic unit of a bone conducting hearing aid and the internal magnetic unit within the magnetic unit assembly can be minimized.

It may be beneficial that the magnetic unit assembly comprises unit for facilitating ingrowth of the tissue surrounding the implanted magnetic unit assembly into the magnetic unit assembly and hereby establishing an attachment of the magnetic unit assembly to the surrounding tissue.

Hereby it is possible to achieve a reliable and strong attachment of the implanted magnetic unit assembly to the surrounding tissue. Accordingly, the magnetic unit assembly according to an embodiment of the disclosure ensures that the distance between contact plates of a hearing aid device and the internal magnetic unit of the magnetic unit assembly can be kept constant.

It may be advantageous that unit for ingrowth of the tissue surrounding the implanted magnetic unit assembly into the magnetic unit assembly comprises one or more holding member(s) that are embedded in or comprise an ingrowth structure for fixing the magnetic unit assembly to the tissue that the magnetic unit assembly is implanted into.

Hereby it is achieved that the ingrowth structure of the magnetic unit assembly can be used as unit for attaching the magnetic unit assembly to the tissue surrounding the implanted magnetic unit assembly.

It may be beneficial that that the unit for ingrowth of the tissue surrounding the implanted magnetic unit assembly into the magnetic unit assembly comprises one single ring magnet (circular or non-circular), or two or more, such as four, magnetic unit preferably evenly distributed along the periphery of an ingrowth structure shaped as a thin disc having a mesh structure with a plurality of apertures.

Such unit may be reliable and safe to use.

It may be an advantage that the magnetic unit are to be enclosed in a housing (e.g. made in a bioinert material such as titanium). The housing may be integrated in the ingrowth structure. The ingrowth structure may be a resilient and soft mesh made in polypropylene by way of example. Sharp corners and stress concentrations are hence avoided and the ingrowth structure also adapt to the contour of the skull.

The magnetic unit assembly may include a unit for positioning the magnetic unit assembly under the periosteum, in between the periosteum and the bone. The placement of the housing and magnet under the periosteum allows for a simple procedure and minimal trauma by which this procedure can be performed. A small incision is made with a dissector and the periosteum is separated from the underlying bone, thus creating a pocket. In this pocket, the housing assembly is inserted and the incision is thereafter closed. The housing is held in place by the periosteum. The housing may be equipped with an ingrowth unit described before (resorbable or permanent). Thus, the magnetic unit assembly may be attached by using an implantation technique similar to the one used to implantation of cochlear implants. Accordingly, it is possible to provide a simple surgery and to achieve a beneficial position of the implanted magnetic unit assembly.

Yet another embodiment includes an ingrowth structure made of thin titanium, the structure may be bent and adapted to the contour of the skull comparable to craniofacial retention meshes.

Part or all of the ingrowth structure could be made of a resorbable material (e.g. such as poly (D,L) lactic acid, PDLLA). In general, the potential for foreign body reaction, infection, and extrusion increases with material that is non-absorbable. Hence, initial fixation is achieved by ingrowth in the resorbable ingrowth structure. After some time (weeks to months) the ingrowth structure is absorbed. With a resorbable structure, it may also be easier to remove the housing if it needs to be replaced.

It may be beneficial that the ingrowth structure is made in a polymer material coated with a titanium layer or another suitable material. The ingrowth structure may be made as a thin circular or oval titanium disc penetrated with circumferential tracks and a plurality of small apertures or holes to favour connective tissue ingrowth and anchorage.

It may be an advantage that unit for ingrowth of the tissue surrounding the implanted magnetic unit assembly into the magnetic unit assembly comprises a disc having a concave shape to mimic the contour of the skull and prevent stress concentrations.

Hereby it is possible to fit the implanted magnetic unit assembly to the contour of the skull in order to minimise the stress of the tissues caused by the magnetic attraction.

It may be advantageous that the implantable disc is made in a soft plastic material.

It may be advantageous that the disc has a basically elliptical cross-section.

Hereby it is possible to prevent stress concentrations.

It may be an advantage that the magnetic unit assembly is not brought into mechanical contact with the bone. Hereby it is possible to maintain a fixed distance from the outer skin surface to the implemented magnetic unit even if patient gains weight or loses weight.

It may be an advantage that the one or more magnetic unit are hermetically sealed.

Hereby it is possible to avoid corrosion of the magnetic unit.

It may be beneficial that the one or more magnetic unit have an arched profile/surface.

Hereby it is possible to reduce the risk of introducing too high pressure or unfavourable pressure distribution causing local pressure concentrations that may lead to skin problems such as ulcer or necrosis and headache.

It may be advantageous that the arched profile/surface is concave.

By applying a concave surface the magnetic unit mimics the anatomy of the head and thus unfavourable pressure distribution can be avoided since reduced magnetic unit attraction can be applied.

It may be beneficial that the magnetic unit assembly comprises one or more, preferably two or more magnetic unit embedded in a disc made in a flexible material.

It is possible to implant such magnetic unit assembly in the soft tissue underneath the skin and the subcutaneous fat. Thus, the magnetic unit of the magnetic unit assembly can be kept positioned close to the skin. Accordingly, the size and strength of the magnetic unit may be reduced.

The magnetic unit assembly may be implemented within the muscle/fat layer in a significant distance from the bone. Accordingly, the magnetic unit assembly may be implemented by unit of a simple surgical procedure.

It may be beneficial that the disc has an elliptic cross-section.

The object of the disclosure can be achieved by a hearing aid system comprising a magnetic unit assembly according to one of the claims 1-12.

It may be advantageous that the hearing aid system comprises at least one contact plate that is magnetically attached to an implanted magnetic unit assembly according to one of the claims 1-12, where the at least one contact plate comprises at least one magnetic unit, where the hearing aid system comprises one or more skin wafer arranged between the skin of the hearing aid user and the at least one contact plate.

Hereby it is possible to distribute the pressure from the contact plate evenly to the skin of the user of the hearing aid. Moreover it is possible to adjust the distance between the implanted magnetic unit(s) and the at least one magnetic unit of the at least one contact plate.

It may be an advantage that a skin wafer is arranged between each of the contact plate(s) and the skin of the hearing aid user, where the skin wafer(s) provided between the contact plate(s) and the skin are configured to regulate the pressure provided by the contact plate(s) towards the skin by changing the thickness of the skin wafer(s).

In the present context, a "hearing device" refers to a device, such as e.g. a hearing aid, a listening device or an active ear-protection device, which is adapted to improve, augment and/or protect the hearing capability of a user by receiving acoustic signals from the user's surroundings, generating corresponding audio signals, possibly modifying the audio signals and providing the possibly modified audio signals as signals to at least one of the user's ears.

A "hearing device" further refers to a device such as an earphone or a headset adapted to receive audio signals electronically, possibly modifying the audio signals and providing the possibly modified audio signals as audible signals to at least one of the user's ears. Such audible signals may e.g. be provided in the form of acoustic signals radiated into the user's outer ears, acoustic signals transferred as mechanical vibrations to the user's inner ears through the bone structure of the user's head.

A hearing device may be configured to be worn in any known way, e.g. as a unit arranged behind the ear, as a unit attached to a fixture implanted into the skull bone, as a partly implanted unit. A hearing device may comprise a single unit or several units communicating electronically with each other.

More generally, a hearing device comprises an input transducer for receiving an acoustic signal from a user's surroundings and providing a corresponding input audio signal and/or a receiver for electronically receiving an input audio signal, a signal processing circuit for processing the input audio signal and an output unit for providing an audible signal to the user in dependence on the processed audio signal. Some hearing devices may comprise multiple input transducers, e.g. for providing direction-dependent audio signal processing. In some hearing devices, the receiver may be a wireless receiver. In some hearing devices, the receiver may be e.g. an input amplifier for receiving a wired signal. In some hearing devices, an amplifier may constitute the signal processing circuit.

In the hearing devices, the output unit may comprise an output transducer, such as vibrator for providing a structure-borne or liquid-borne acoustic signal.

In the hearing device, the vibrator may be adapted to provide a structure-borne acoustic signal transcutaneously or percutaneously to the skull bone. In some hearing devices, the vibrator may be adapted to provide a structure-borne acoustic signal to a middle-ear bone and/or to the cochlea.

A "hearing aid system" refers to a system comprising one or two hearing devices, and a "binaural hearing system" refers to a system comprising one or two hearing devices and being adapted to cooperatively provide audible signals to both of the user's ears. Hearing systems or binaural hearing systems may further comprise "auxiliary devices", which communicate with the hearing devices and affect and/or benefit from the function of the hearing devices. Auxiliary devices may be e.g. remote controls, remote microphones, audio gateway devices, mobile phones, public-address systems, car audio systems or music players. Hearing devices, hearing systems or binaural hearing systems may e.g. be used for compensating for a hearing-impaired person's loss of hearing capability, augmenting or protecting a normal-hearing person's hearing capability and/or conveying electronic audio signals to a person.

DESCRIPTION OF THE DRAWINGS

The disclosure will become more fully understood from the detailed description given herein below. The accompanying drawings are given by way of illustration only, and thus, they are not limitative of the present disclosure. In the accompanying drawings:

FIG. 1 *b*) shows a schematic view of a prior art bone conducting hearing aid system;

FIG. 4 *b*) shows a schematic view of a magnetic unit assembly according to an embodiment of the disclosure;

FIG. 5 *b*) shows another schematic view of the magnetic unit assembly shown in FIG. 5 *a*).

FIG. 6 *a*) shows a schematic view of a magnetic unit assembly according to an embodiment of the disclosure anchored in the temporal bone of a user;

FIG. 6 *b*) shows a schematic cross-sectional view of a magnetic unit assembly according to an embodiment of the disclosure;

FIG. 6 *c*) shows a schematic side view of the magnetic unit assembly shown in FIG. 6 *b*)

DETAILED DESCRIPTION

Referring now in detail to the drawings for the purpose of illustrating preferred embodiments of the present disclosure, different views of magnetic unit assembly according to embodiments of the disclosure are illustrated in FIG. 2-7.

Figure 1:
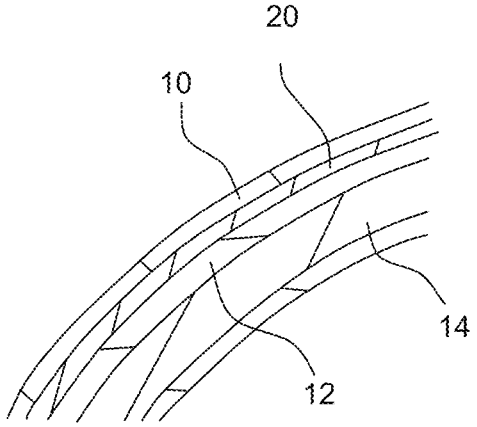
FIG. 1 *a*) shows a schematic close-up view of the soft tissue, lining and bone structure of the head of a hearing aid user.
Figure 1:
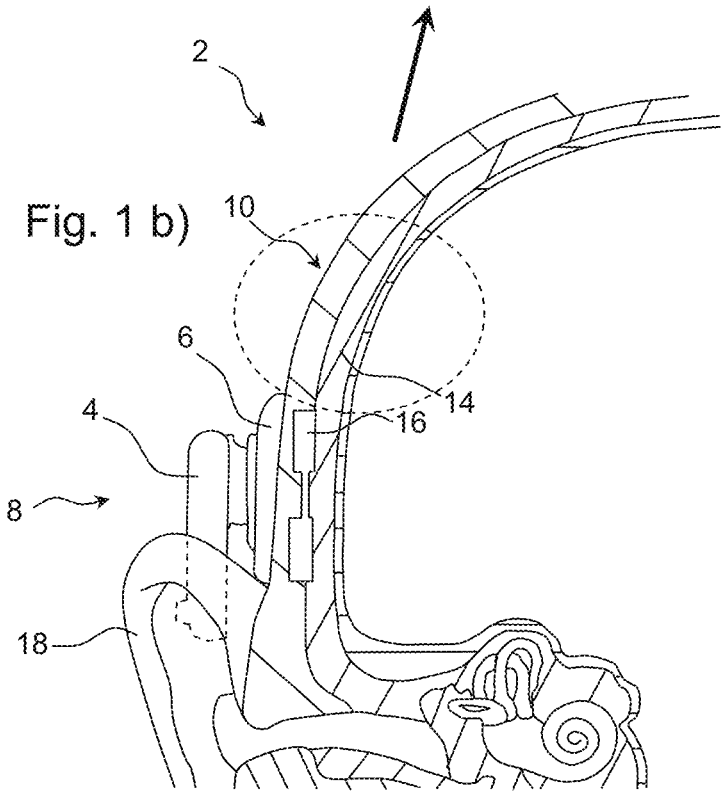

FIG. 1 *a*) is a schematic cross-sectional close-up view of a section of the head of a hearing aid user. The section comprises an outer layer of skin 10 arranged outside a layer of subcutaneous fat 20. A layer of muscle and fat 12 is arranged under the layer of subcutaneous fat 20, while the layer of muscle and fat 12 surrounds a bone layer 14.

FIG. 1 *b*) shows a schematic view of a prior art bone conducting hearing aid system 8. The bone conducting hearing aid system 8 is attached on the head of a user 2. The bone conducting hearing aid system 8 comprises an external hearing aid unit comprising a sound processor 4 and a vibrator. The sound processor 4 is connected to a skin contact pressure plate 6 that is magnetically attached to an implanted unit 16 under the skin. A part of the bone conducting hearing aid system 8 is arranged behind the ear 18 of the hearing aid user 2.

The vibrator transforms an electrical signal into mechanical vibrations and the skin contact pressure plate 6 transmits the vibrations from the vibrator to the implanted unit 16 when the external hearing aid device 8 is magnetically fixed to the implanted unit 16. The sound is transmitted by bone conduction via the skull to the bony cochlea.

A significant retention force is required to maintain the hearing aid device 8 magnetically fixed to the implanted unit 16. The load on the soft tissue 10, 20, 12 should be minimised in order to prevent short or long term problems such as ischemia or stress concentrations. Too high pressure or unfavourable pressure distribution causing local pressure concentrations may cause skin problems such as ulcer or necrosis and headache.

The implantable magnetic unit system 16 is anchored to the temporal bone. This may be established by means of bone screws, or by placing the magnetic unit system 16 unanchored on the bone surface below the innermost soft tissue layer (musculature) 12.

Depending on the total thickness of the soft tissue lining 10, 20, 12 on the temporal bone 14, skin thinning of the soft tissue 10, 20, 12 above the implantable magnetic unit 16 may be required in order to ensure proper attraction of the outer magnetic unit within the contact pressure plate 6. Skin thinning introduces risk of wound.

Figure 2:
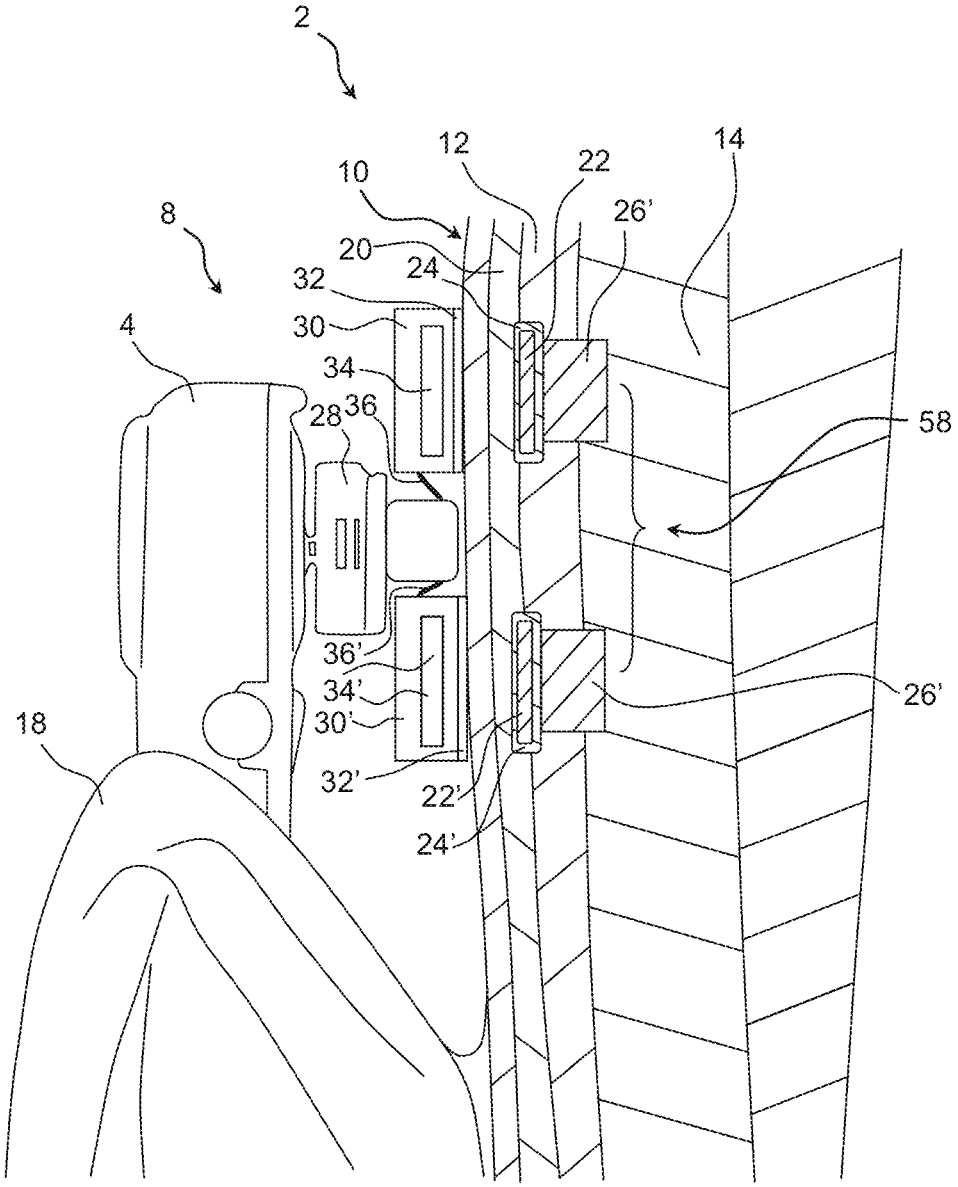
FIG. 2 shows a schematic view of a bone conducting hearing aid system attached to the head of the user by means of a magnetic unit assembly according to an embodiment of the disclosure.

FIG. 2 shows a schematic view of a bone conducting hearing aid system 8 attached to the head of the user 2 by means of a magnetic unit assembly 58 according to an embodiment of the disclosure. The bone conducting hearing aid system 8 comprises a sound processor 4 arranged behind and above the ear 18 of the user 2.

The bone conducting hearing aid system 8 comprises two contact plates 30, 30' that are mechanically connected to the vibrator 28 by means of connection members 36, 36'. Each of the contact plates 30, 30' comprise a magnetic unit 34, 34' integrated in the contact plate 30, 30'.

The contact plates 30, 30' are attached to the skin 10 of the user by means of magnetic attraction to the magnetic unit assembly 58.

The magnetic unit assembly 58 consists of two magnetic unit, 22, 22'. The magnetic unit 22, 22', 34, 34' may be neodymium magnetic unit made from an alloy of neodymium, iron and boron ($Nd_2Fe_{14}B$) or samarium cobalt magnetic unit (SmCo) by way of example. Each of the two magnetic unit, 22, 22' are integrated in a corresponding holding member 24, 24' that is anchored to the temporal bone 14 by means of corresponding abutments 26, 26'.

A skin wafer 32, 32' is arranged between each of the contact plates 30, 30' and the skin 10. The skin wafer 32, 32' provided between the contact plates 30, 30' and the skin 10 can be used to regulate the pressure provided by the contact plates 30, 30' towards the skin 10. The pressure can be changed by changing the thickness of the skin wafers 32, 32'.

The thickness of the layer of skin (also referred to as the dermis) 10, the layer of subcutaneous fat and the layer of muscle/fat 12 outside the temporal bone 14 ranges between 2 and 11 mm between patients. In contrast, the thickness of the epidermis and dermis layer ranges between 1-4 mm between patients.

The magnetic unit assembly 58 is placed in the soft tissue between skin 10 and the subcutaneous fat 20.

The magnetic unit assembly 58 comprises two hermetically sealed magnetic unit 22, 22'. The magnetic unit assembly 58 may comprise an ingrowth structure for anchoring the magnetic unit assembly 58 in the soft tissue. The magnetic unit assembly 58 according to an embodiment of the disclosure ensures that the distance between the contact plates 30, 30' and the internal magnetic unit 22, 22' of the magnetic unit assembly 58 is kept constant.

The distances between the epidermal surface and the internal magnetic unit 22, 22' are determined at the time of surgery by the position of the magnetic unit 22, 22' on the abutment 26, 26'.

The magnetic unit 22, 22' may have a concave shape to prevent high pressure points. The abutments 26, 26' are anchored in the bone 14 and the height of the abutments 26, 26' can be individually chosen in order to meet patient specific requirements. The abutments 26, 26' protrude through the soft tissue 12 positioning the magnetic unit 22, 22' at a defined distance from the epidermal surface.

The abutments 26, 26' may be made in titanium. The abutments may comprise mesh structure (see FIG. 6*b* and FIG. 6 *c*) allowing tissue ingrowth through the structure. The amount of titanium (or another material) may be reduced and hence the risk for infection may be reduced, since the mesh structure is enclosed by vascularised soft tissue.

It is possible to provide a mesh structure in a soft material, e.g. plastic like silicone or a thermoplastic elastomer. By choosing a soft and resilient material the risk for high pressure points can be reduced, e.g. when the patient is sleeping with the implant side against a pillow.

The abutments 26, 26' could also be supplied in one height whereby the distance to the epidermal surface is controlled by placing the abutments in a recess in temporal bone 14. The depths of the recesses would be determined by the patient soft tissue thickness.

The magnetic unit assembly 58 according to an embodiment of the disclosure provides a number of advantages.

A short distance between external magnetic unit 34, 34' and the internal magnetic unit 22, 22' can be achieved.

The implanted magnetic unit assembly 58 will be in the same distance from the outer skin surface even if patient gain or lose weight (subcutaneous fat increase or decrease).

Due to the short distance between the external magnetic unit 34, 34' and the internal magnetic unit 22, 22', the size of the magnetic unit 22, 22', 34, 34' can reduced compared with the prior art.

It is not necessary to provide recesses in the bone 14 for anchoring the magnetic unit assembly 58.

Only a simple surgical procedure is required to provide a patient with a magnetic unit assembly 58 according to an embodiment of the disclosure.

If the subcutaneous tissue 12 grows, the implanted magnetic unit assembly 58 will maintain its distance to the outer skin 10 surface.

Figure 3:
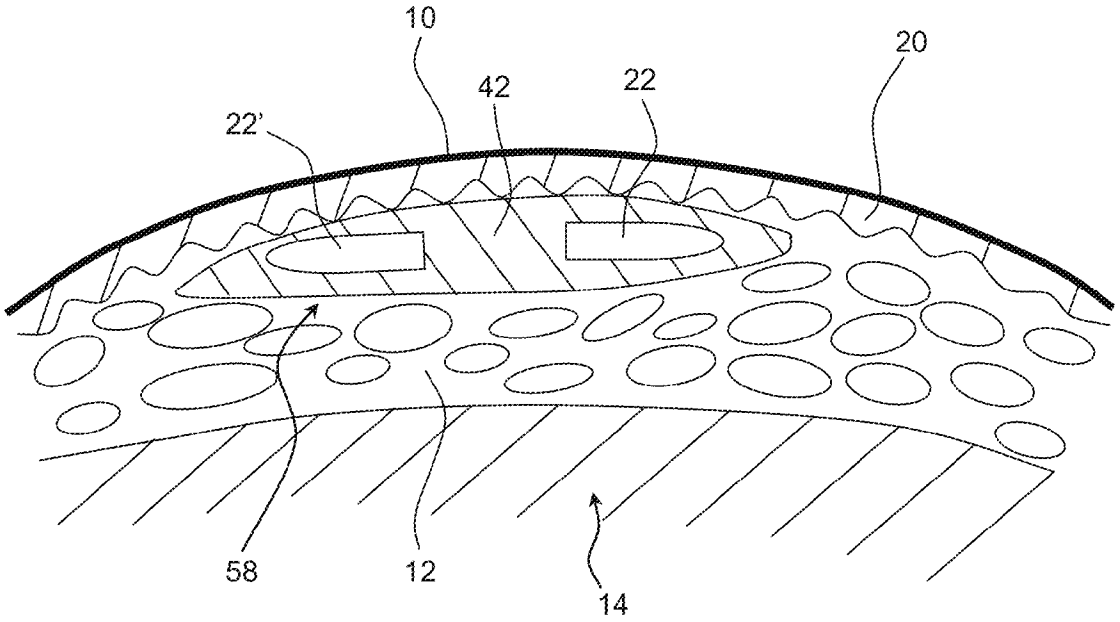
FIG. 3 shows a schematic cross-sectional view of a magnetic unit assembly according to an embodiment of the disclosure.

FIG. 3 shows a schematic cross-sectional view of a magnetic unit assembly 58 according to an embodiment of the disclosure. The magnetic unit assembly 58 is shaped as a disc 42 having a basically elliptical cross-section. The magnetic unit assembly 58 comprises two magnetic unit 22, 22' embedded in a disc 42 made in a flexible material.

The magnetic unit assembly 58 is implanted in the soft tissue underneath the skin 10 and the subcutaneous fat 20. Thus, the magnetic unit 22, 22' of the magnetic unit assembly 58 are arranged close to the skin 10. Accordingly, the size and strength of the magnetic unit 22, 22' may be reduced.

The magnetic unit assembly 58 is implemented within the muscle/fat 12 layer in a significant distance from the bone 14. Accordingly, the magnetic unit assembly 58 may be implemented by means of a simple surgical procedure.

Figure 4:
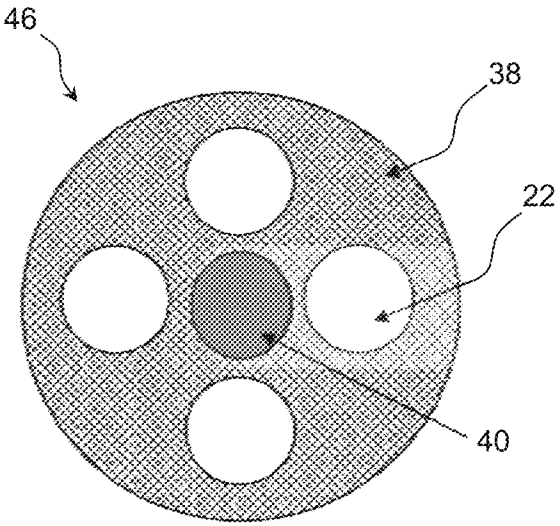
FIG. 4 *a*) shows a schematic view of a bone conducting hearing aid system attached to the head of the user by means of a magnetic unit assembly according to an embodiment of the disclosure.
Figure 4:
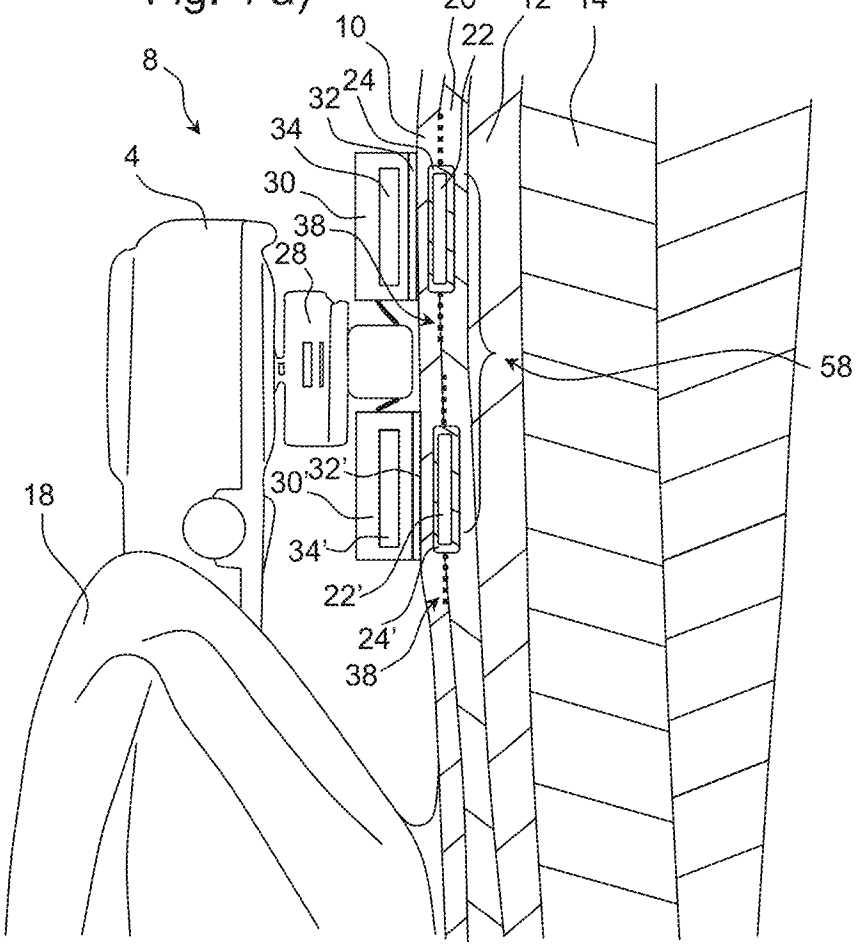

FIG. 4 *a*) is a schematic view of a bone conducting hearing aid system 8 attached to the head of the user by means of a magnetic unit assembly 58 according to an embodiment of the disclosure.

The bone conducting hearing aid system 8 comprises a sound processor 4 arranged behind and above the ear 18 of the user of the hearing aid system 8. The bone conducting hearing aid system 8 comprises two contact plates 30, 30' mechanically connected to a vibrator 28 by means of connection members 36, 36'. Each of the contact plates 30, 30' comprise a magnetic unit 34, 34' integrated in a corresponding contact plate 30, 30'.

The contact plates 30, 30' are retained to the skin 10 of the user by means of magnetic attraction provided by using the magnetic unit assembly 58.

The magnetic unit assembly 58 consists of a number of magnetic unit, 22, 22' (e.g. neodymium magnetic unit). Each of the magnetic unit, 22, 22' are integrated in a corresponding holding member 24, 24' that is embedded in an ingrowth structure 38 for fixing the magnetic unit assembly 58 to the tissue that it is implanted into.

A skin wafer 32, 32' is arranged between each of the contact plates 30, 30' and the skin 10. The pressure provided by the contact plates 30, 30' towards the skin 10 can be regulated by using the skin wafers 32, 32' provided between the contact plates 30, 30' and the skin 10. The pressure can be changed by changing the thickness of the skin wafers 32, 32'.

The magnetic unit assembly 58 is arranged in a relative short distance to the outer surface of the skin 10. Accordingly, the distance between the external magnetic unit 34, 34' and the magnetic unit 22, 22' in the magnetic unit assembly 58 is short. Accordingly, the size of the magnetic unit 22, 22' in the magnetic unit assembly 58 can be reduced compared to a prior art magnetic unit assembly.

Moreover, the magnetic unit assembly 58 shown in FIG. 4 *a*) can be implemented by means of a simple surgical procedure.

FIG. 4 *b*) is a schematic view of a magnetic unit assembly 58 according to an embodiment of the disclosure. The magnetic unit assembly 58 is an implant 46 configured to be implanted in the soft tissue in the same tissue layer as the magnetic unit assembly 58 shown in FIG. 4 *a*).

The magnetic unit assembly 58 comprises four magnetic unit 22 evenly distributed along the periphery of an ingrowth structure 38. The ingrowth structure 38 is shaped as a thin disc having a mesh structure with a plurality of apertures through which the tissue surrounding an implanted magnetic unit assembly 58 can grow. Hereby a firm and reliable attachment of the magnetic unit assembly 58 can be achieved.

A circular vibration faceplate area is provided centrally and concentrically with the ingrowth structure disc 38.

The magnetic unit may be enclosed in a housing (e.g. made in titanium in order to prevent corrosion). The housing may be integrated in the ingrowth structure 38. The ingrowth structure 38 may be a resilient and soft mesh made in polypropylene by way of example.

The ingrowth structure 38 may alternatively be made in another polymer coated with a titanium layer or another suitable material. The ingrowth structure 38 may be made as a thin circular or oval titanium disc penetrated with circumferential tracks and a plurality of small apertures or holes to favour connective tissue ingrowth and anchorage.

It may be an advantage that the disc (implant) 46 has a concave shape to mimic the contour of the skull and prevent stress concentrations. The disc (implant) 46 could also be made of a soft plastic material. It may be an advantage that the disc 46 has an elliptical cross-section in order to avoid force concentrations.

Figure 5:
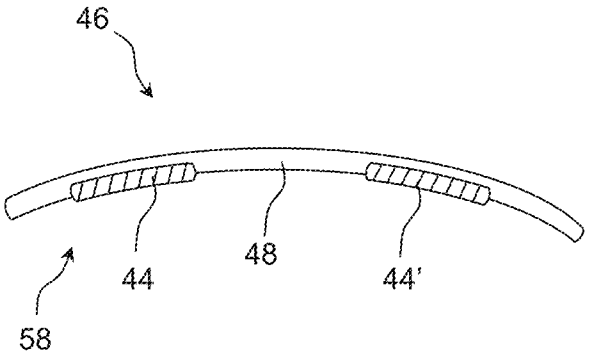
FIG. 5 *a*) shows a schematic view of a magnetic unit assembly according to an embodiment of the disclosure.
Figure 5:
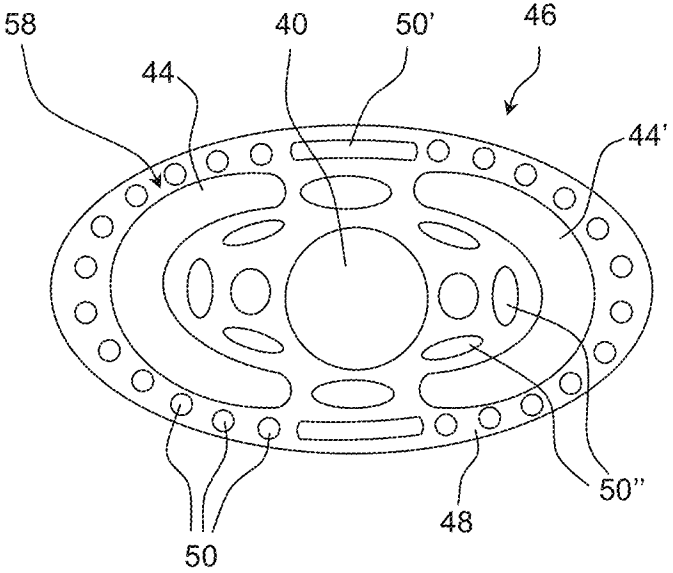

FIG. 5 *a*) is a schematic cross-sectional view of a magnetic unit assembly 58 according to an embodiment of the disclosure. The magnetic unit assembly 58 comprises a disc 48 having a concave structure. The magnetic unit assembly 58 constitutes an implant 46 configured to be implanted in the soft tissue of a hearing aid user.

The magnetic unit assembly 58 may be made in titanium or another material suitable for being implanted into the soft tissue of a hearing aid user. A plurality of apertures 50, 50', 50" are provided in the disc 48. These apertures/holes are provided to facilitate tissue ingrowth.

FIG. 5 *b*) is another schematic view of the magnetic unit assembly shown in FIG. 5 *a*). The magnetic unit assembly 58 is embedded in an implant 46 comprising a disc 48 having a concave structure made in e.g. titanium.

A vibrator faceplate area 40 is provided centrally within the disc 48.

The magnetic unit assembly 58 is implanted during a surgical procedure, in which the dermis is separated from the underlying hypodermis/subcutis with a tool ensuring that a cleavage is created about 3 mm from the epidermis. Hereafter the implant 46 may be inserted into the cleavage and the incision can be closed. A healing time is required in order to ensure ingrowth of the implant 46.

FIG. 6 *a*) is a schematic view of a magnetic unit assembly 58 according to an embodiment of the disclosure anchored in the temporal bone 14 of a user of a bone anchored hearing aid device. The magnetic unit assembly 58 comprises two magnetic unit 22 arranged in the subcutaneous fat layer 20 between the skin (dermis) 10 and the muscle/fat layer 12 in a distance from the temporal bone 14.

The magnetic unit 22 are anchored to the temporal bone 14 by means of threaded screw members 52, 52' screwed into the temporal bone 14. Each magnetic unit 22 is attached to an abutment 26, 26' that is mechanically attached to the corresponding screw member 52, 52'.

The magnetic unit assembly 58 hereby makes it possible to provide a short distance between external magnetic unit (not shown) and the internal magnetic unit 22, 22'.

FIG. 6 *b*) is a schematic cross-sectional view of a magnetic unit assembly 58 corresponding to one of the two magnetic unit assembly portions shown in FIG. 6 *a*). The magnetic unit 22 has a concave shape. This shape is applied in order to prevent high pressure points when external magnetic unit are attached to the skin of the user of the hearing aid.

The magnetic unit assembly 58 comprises an abutment 26 configured to be anchored in the temporal bone as indicated in FIG. 6 *a*). The height of the abutment 26 may be individually chosen.

The abutment 26 may be made in could be a solid titanium post, however, the abutment shown in FIG. 6 *b*) illustrates an abutment having a mesh structure 54 allowing tissue ingrowth through the apertures 50.

Hereby it is possible to reduce the amount of titanium and thus, the risk for infection can be reduced due to the fact that the mesh structure 54 is enclosed by vascularised soft tissue.

The magnetic unit assembly 58 comprises a mesh members 56 provided with apertures 50 allowing for ingrowth of the tissue surrounding the magnetic unit assembly 58.

The abutment 26 is attached to a threaded screw member 52.

FIG. 6 *c*) is a schematic side view of the magnetic unit assembly 58 shown in FIG. 6 *b*). The magnetic unit assembly 58 comprises a concave magnetic unit 22 attached to an abutment 26 comprising a mesh structure 54 that comprises a plurality of mesh members 56 provided with apertures 50.

The abutment 26 is attached to (integrated into) a threaded screw member 52.

It would be possible to make the mesh structure 54 in a soft material, such as a plastic material like silicone or a thermoplastic elastomer. It may be an advantage to make the abutment 26 in a resilient material in order to reduce the risk for creating high pressure when the patient is sleeping with the implant side against a pillow.

Figure 7:
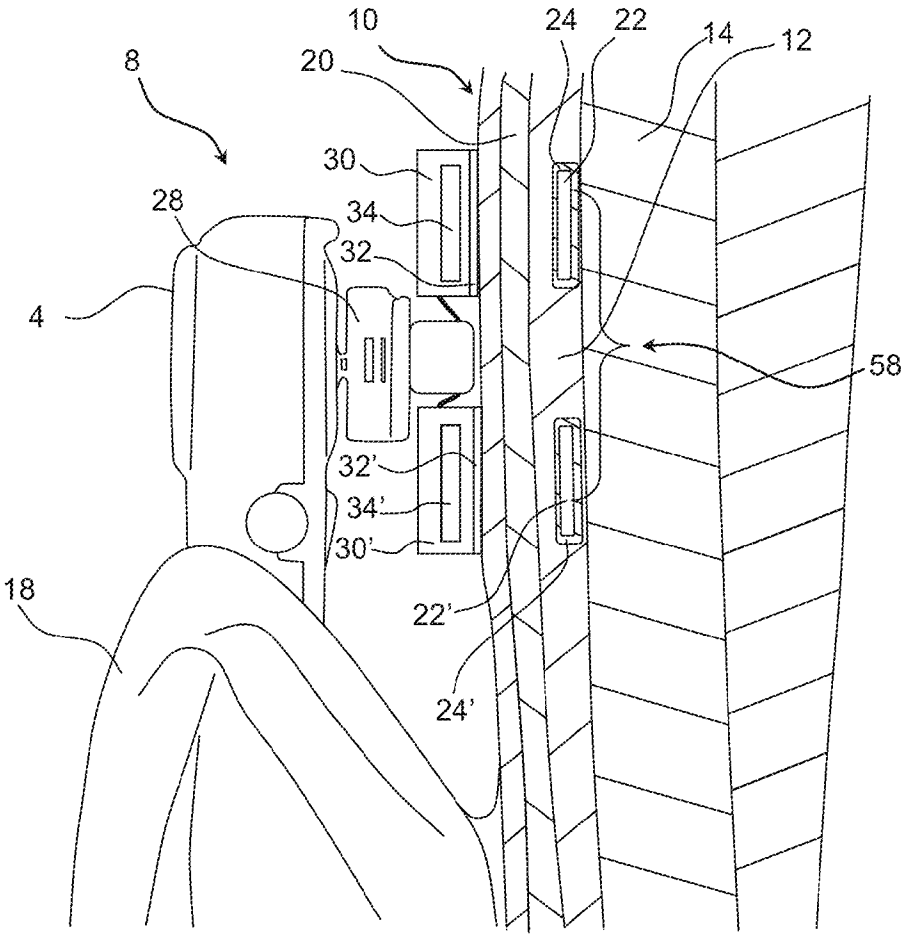
FIG. 7 shows a schematic view of a bone conducting hearing aid system attached to the head of the user by unit of a magnetic unit assembly according to an embodiment of the disclosure.

FIG. 7 is a schematic view of a bone conducting hearing aid system 8 attached to the head of the user by means of a magnetic unit assembly 58 according to an embodiment of the disclosure. The bone conducting hearing aid system 8 comprises a sound processor 4 arranged behind and above the ear 18 of the user.

The bone conducting hearing aid system 8 comprises a first contact plate 30 and a second contact plate 30'. The contact plates are mechanically connected to a vibrator 28 by means of connection members 36, 36'. The first contact plate 30 comprises a first hermetically sealed magnetic unit 34 integrated in the first contact plate 30, while the second contact plate 30' comprises a second hermetically sealed magnetic unit 34' integrated in the second contact plate 30'.

The contact plates 30, 30' are retained to the skin 10 of the user by means of magnetic unit attraction between the first magnetic unit 34 and a corresponding implanted magnetic unit 22 and between the second magnetic unit 34' and a corresponding second implanted magnetic unit 22'.

The two magnetic unit, 22, 22' are integrated in holding members 24, 24' anchored to the temporal bone 14 by means of abutments 26, 26'.

Skin wafers 32, 32' are arranged between the contact plates 30, 30' and the skin 10. The skin wafers 32, 32' are used to regulate the pressure provided by the contact plates 30, 30' towards the skin 10, by changing the thickness of the skin wafers 32, 32'.

The magnetic unit assembly 58 is positioned between the periosteum 20 and the bone 14. The placement of the housing and magnet under the periosteum allows for a simple procedure and minimal trauma by which this procedure can be performed. A small incision is made with a dissector and the periosteum is separated from the underlying bone, thus creating a pocket. In this pocket, the housing assembly is inserted and the incision is thereafter closed. The housing is held in place by the periosteum. The housing may be equipped with an ingrowth unit described before (resorbable or permanent). Thus, the magnetic unit assembly 58 may be attached by using an implantation technique similar to the one used to implantation of cochlear implants. Accordingly, it is possible to provide a simple surgery and to achieve a beneficial position of the implanted magnetic unit assembly 58.

LIST OF REFERENCE NUMERALS

2 Hearing aid user
4 Sound processor
6 Contact pressure plate
8 Hearing aid system
10 Skin
12 Muscle/fat
14 Bone
16 Implant
18 Ear
20 Subcutaneous fat
22, 22' Magnetic unit
24, 24' Holding member
26, 26' Abutment
28 Vibration member
30, 30' Contact plate
32, 32' Skin wafer
34, 34' Magnetic unit
36, 36' Connection member
38 Ingrowth structure
40 Vibration faceplate area
42 Disc
44, 44' Magnetic unit
46 Implant
48 Disc
50, 50', 50" Aperture
52, 52' Screw member
54 Mesh structure
56 Mesh member
58 Magnetic unit assembly

The invention claimed is:

1. A magnetic unit assembly for a bone conducting hearing aid, which magnetic unit assembly is implantable and comprises one or more magnetic unit and unit for attaching the one or more magnetic unit to the tissue surrounding the magnetic unit assembly when the magnetic unit assembly is implanted in the body of a hearing aid user, the magnetic unit assembly comprising a unit for positioning at least a portion of the one or more magnetic unit in the soft tissue between dermis and the subcutaneous fat or the muscle/fat layer, wherein said unit for positioning comprises an abutment configured to be mechanically attached to a screw member, the screw member being configured to be screwed into temporal bone of the hearing aid user, said abutment having a mesh structure comprising a plurality of apertures.

2. A magnetic unit assembly according to claim 1, wherein the magnetic unit assembly comprises the unit for positioning the one or more magnetic unit in the soft tissue between dermis and the subcutaneous fat.

3. A magnetic unit assembly according to claim 1, wherein the magnetic unit assembly comprises the unit for positioning the one or more magnetic unit under the periosteum, in between the periosteum and the bone.

4. A magnetic unit assembly according to any claim 1, wherein the magnetic unit assembly comprises unit for ingrowth of the tissue surrounding the implanted magnetic unit assembly into the magnetic unit assembly and thereby establishing an attachment of the magnetic unit assembly to the surrounding tissue.

5. A magnetic unit assembly according to claim 4, wherein the unit for ingrowth of the tissue surrounding the implanted magnetic unit assembly into the magnetic unit assembly comprises one or more holding member(s) that are embedded in or comprise an ingrowth structure for fixing the magnetic unit assembly to the tissue that the magnetic unit assembly is implanted into.

6. A magnetic unit assembly according to claim 5, wherein the unit for ingrowth of the tissue surrounding the implanted magnetic unit assembly into the magnetic unit assembly comprises two or more magnetic unit evenly distributed along the periphery of an ingrowth structure shaped as a thin disc having a mesh structure with a plurality of apertures.

7. A magnetic unit assembly according to claim 5, wherein the unit for ingrowth of the tissue surrounding the implanted magnetic unit assembly into the magnetic unit assembly comprises a disc having a concave shape to mimic the contour of the skull and prevent stress concentrations.

8. A magnetic unit assembly according to claim 1, wherein the one or more magnetic unit are hermetically sealed and/or one or more magnetic unit have an arched profile/surface.

9. A magnetic unit assembly according to claim 8, wherein the arched profile/surface is concave or convex.

10. A magnetic unit assembly according to claim 1, wherein the magnetic unit assembly comprises one or more, preferably two or more magnetic unit embedded in a disc made in a flexible material.

11. A magnetic unit assembly according to claim 10, wherein the disc has an elliptic cross-section.

12. A magnetic unit assembly for a bone conducting hearing aid, which magnetic unit assembly is implantable and comprises one or more magnetic unit and unit for attaching the one or more magnetic unit to the tissue surrounding the magnetic unit assembly when the magnetic unit assembly is implanted in the body of a hearing aid user, the magnetic unit assembly comprising a unit for positioning at least a portion of the one or more magnetic unit in the soft tissue between dermis and the subcutaneous fat or the muscle/fat layer, wherein the magnetic unit assembly comprises a unit for ingrowth of the tissue surrounding the implanted magnetic unit assembly into the magnetic unit assembly and thereby establishing an attachment of the magnetic unit assembly to the surrounding tissue, and wherein the unit for ingrowth of the tissue surrounding the implanted magnetic unit assembly into the magnetic unit assembly comprises two or more magnetic unit evenly distributed along the periphery of an ingrowth structure shaped as a thin disc having a mesh structure with a plurality of apertures.

13. A magnetic unit assembly according to claim 12, wherein said disc has a concave shape to mimic the contour of the skull and prevent stress concentrations.

14. A magnetic unit assembly according to claim 13, wherein the disc has a basically elliptical cross-section.

15. A magnetic unit assembly according to claim 12, wherein the disc has a basically elliptical cross-section.

16. A magnetic unit assembly according to claim 12, wherein the unit for ingrowth of the tissue surrounding the implanted magnetic unit assembly into the magnetic unit assembly comprises a disc having a concave shape to mimic the contour of the skull and prevent stress concentrations.

17. A hearing aid system comprising a magnetic unit assembly, wherein the magnetic unit assembly is implantable and comprises one or more magnetic unit and unit for attaching the one or more magnetic unit to the tissue surrounding the magnetic unit assembly when the magnetic unit assembly is implanted in the body of a hearing aid user, the magnetic unit assembly comprising unit for positioning at least a portion of the one or more magnetic unit in the soft tissue between dermis and the subcutaneous fat or the muscle/fat layer, wherein said unit for positioning comprises an abutment configured to be mechanically attached to a screw member, the screw member being configured to be screwed into temporal bone of the hearing aid user, said abutment having a mesh structure comprising a plurality of apertures.

18. A hearing aid system according to claim 17, wherein the hearing aid system comprises at least one contact plate that is magnetically attached to an implanted magnetic unit assembly that comprises one or more magnetic unit and unit for attaching the one or more magnetic unit to the tissue surrounding the magnetic unit assembly when the magnetic unit assembly is implanted in the body of a hearing aid user, the magnetic unit assembly comprising unit for positioning at least a portion of the one or more magnetic unit in the soft tissue between dermis and the subcutaneous fat or the muscle/fat layer, where the at least one contact plate comprises at least one magnetic unit, where the hearing aid system comprises one or more skin wafer arranged between the skin of the hearing aid user and the at least one contact plate.

19. A hearing aid system according to claim 18, wherein a skin wafer is arranged between each of the contact plate(s) and the skin of the hearing aid user, where the skin wafer(s) provided between the contact plate(s) and the skin are configured to regulate the pressure provided by the contact plate(s) towards the skin by changing the thickness of the skin wafer(s).

20. A hearing aid system comprising a magnetic unit assembly for a bone conducting hearing aid, which magnetic unit assembly is implantable and comprises one or more magnetic unit and unit for attaching the one or more magnetic unit to the tissue surrounding the magnetic unit assembly when the magnetic unit assembly is implanted in the body of a hearing aid user, the magnetic unit assembly comprising a unit for positioning at least a portion of the one or more magnetic unit in the soft tissue between dermis and the subcutaneous fat or the muscle/fat layer, wherein the magnetic unit assembly comprises a unit for ingrowth of the tissue surrounding the implanted magnetic unit assembly into the magnetic unit assembly and thereby establishing an attachment of the magnetic unit assembly to the surrounding tissue, and wherein the unit for ingrowth of the tissue surrounding the implanted magnetic unit assembly into the magnetic unit assembly comprises two or more magnetic unit evenly distributed along the periphery of an ingrowth structure shaped as a thin disc having a mesh structure with a plurality of apertures.

21. A hearing aid system according to claim 20, wherein the hearing aid system comprises at least one contact plate that is magnetically attached to an implanted magnetic unit assembly that comprises one or more magnetic unit and unit for attaching the one or more magnetic unit to the tissue surrounding the magnetic unit assembly when the magnetic unit assembly is implanted in the body of a hearing aid user, the magnetic unit assembly comprising unit for positioning at least a portion of the one or more magnetic unit in the soft tissue between dermis and the subcutaneous fat or the muscle/fat layer, where the at least one contact plate comprises at least one magnetic unit, where the hearing aid system comprises one or more skin wafer arranged between the skin of the hearing aid user and the at least one contact plate.

22. A hearing aid system according to claim 21, wherein the skin wafer is arranged between each of the contact plate(s) and the skin of the hearing aid user, where the skin wafer(s) provided between the contact plate(s) and the skin are configured to regulate the pressure provided by the contact plate(s) towards the skin by changing the thickness of the skin wafer(s).

* * * * *